US005467895A

United States Patent [19]

Fung

[11] Patent Number: 5,467,895

[45] Date of Patent: Nov. 21, 1995

[54] TICKET DISPENSING MACHINE

[75] Inventor: Man K. Fung, Brisbane, Australia

[73] Assignee: TDM Pty Ltd, Queensland, Australia

[21] Appl. No.: 336,665

[22] Filed: Nov. 7, 1994

[51] Int. Cl.[6] ..... B65G 59/06

[52] U.S. Cl. ..... 221/259; 221/270; 221/273; 221/303; 221/309; 271/131

[58] Field of Search ..... 221/252, 259, 221/268, 270, 271, 273, 303, 307, 309, 304; 271/42, 131, 144

[56] References Cited

U.S. PATENT DOCUMENTS

| | | | |
|---|---|---|---|
| 213,000 | 3/1879 | Sperry | 221/304 X |
| 2,637,609 | 5/1953 | Berg | 221/259 X |
| 4,653,667 | 3/1987 | Wettlën | 221/259 X |
| 5,074,432 | 12/1991 | MacNamara . | |
| 5,232,123 | 8/1993 | Richardson et al. | 221/259 |
| 5,335,822 | 8/1994 | Kasper | 221/259 |

*Primary Examiner*—William E. Terrell
*Assistant Examiner*—Dean A. Reichard
*Attorney, Agent, or Firm*—Nixon & Vanderhye

[57] ABSTRACT

A ticket dispensing machine which can dispense the lowermost ticket from a column of tickets, has a reciprocating arm member which includes a selector having a rocker arm to facilitate engagement with, and ejection of tickets. This allows the machine to efficiently dispense tickets which are distorted.

13 Claims, 4 Drawing Sheets

TICKET DISPENSING MACHINE

FIELD OF THE INVENTION

This invention relates to an improved ticket dispensing machine and particularly to a machine which can dispense tickets which may be curved or otherwise distorted in the machine. The machine is particularly suitable for dispensing card type tickets, such as "scratch it" tickets.

BACKGROUND ART

Ticket dispensing machines to dispense "scratch it" tickets, other types of gaming cards, or other types of cards known are enjoying increased popularity. The machines are approximately the size of a domestic refrigerator, are self-contained and are usually placed in shopping malls, inside or outside shops, service stations, and the like. To obtain a ticket or card, a person inserts a coin and a ticket is ejected. These machines usually have separate vertical columns of tickets and the tickets may be the same or different such that the purchaser may make a selection if desired. The tickets may also be of the same or different lengths but are usually approximately the same width and thickness. An example of a ticket dispensing machine is given in U.S. Pat. No. 5,074,432.

A disadvantage with this earlier machine, and with other machines, is that reliable ticket ejection does not occur if the tickets are even slightly distorted. Thus, unless the tickets in the ticket column are perfectly flat, tickets will get stuck and not be ejected. Distortion of the tickets is common during manufacture and transportation of the tickets and a typical distortion is that the ticket is curved across its width.

OBJECT OF THE INVENTION

The present invention has developed several improvements which allow a ticket dispensing machine to efficiently dispense tickets even in situations where the tickets are not perfectly flat.

We achieve this by providing the ticket dispensing portion of the machine with improvements which will allow distorted cards to be cleanly and efficiently ejected.

It is therefore an object of the invention to provide improvements to a ticket dispensing machine which can allow it to work efficiently with tickets or cards which are not perfectly flat.

In one form, the invention resides in a device for pushing a lowermost ticket in a vertical column of tickets located in a ticket dispensing machine, the device having a main body adapted to be pivotly mounted adjacent a forward portion to a reciprocating arm member, the main body having an upper surface adapted to contact or be closely spaced from the underside surface of the lowermost ticket, a rocker arm pivotly attached to a rear portion of the main body and having a portion which can engage with the rear edge of the lowermost ticket, the main body adapted to be biased against the lowermost ticket in use.

The upper surface of the main body of the device may be curved in a concave manner, and the rocker arm may have an upper surface which may also be curved to follow the curvature of the upper surface of the main body.

The portion of the rocker arm which engages with the rear edge of the ticket is preferably an upstanding shoulder which is dimensioned to contact the rear edge of only the lowermost ticket. That is, the upstanding shoulder is preferably dimensioned such that it does not catch the ticket immediately above the lowermost ticket.

The device may be formed from plastic or other suitable material and may be removably attached to the arm member. It is also preferred that the device can be pivotally attached along various portions of the arm member to allow it to be used for tickets of different lengths.

The device may be pivotally biased into engagement with the lowermost ticket of the ticket column by a biasing member which may extend between the device and the arm member. The biasing member suitably comprises a spring.

The device may comprise part of a larger apparatus for supporting a column of tickets and for engaging the lowermost ticket in the column, the apparatus comprising an arm member adapted for reciprocal movement between an extended ticket ejecting position and a retracted position, a platform for supporting the bottom of a column of tickets, and where the arm member includes the device as described above.

The platform may be sized and shaped to be complementary to the column of tickets supported above and by the platform. Preferably, the platform is of a length to allow it to support at least the longest possible type of ticket which may be used by the ticket dispensing machine. The platform may be fixed in position and may have a longitudinal slot passing therethrough. The reciprocating arm member may be positioned below the platform, and the device attached to the arm member may extend through the slot with a portion of the device extending above the platform surface. Reciprocation of the arm member therefore causes reciprocation of the device along the slot.

The arm member may have a plurality of spaced apart engagement means to which the device can be pivotally attached. The engagement means may be linearly spaced and may comprise hooks under which a pivot shaft of the device may attach to pivotly engage the device to the arm member. The device is preferably removably attachable to each of the hooks such that it can be moved and re-positioned on the arm member at a desired location (corresponding to the length of the ticket).

The upper surface of the platform is preferably substantially flat along its length but curved or having downwardly sloping portions along its width. The curved or sloping configuration can assist in dispensing tickets which are not perfectly flat.

The arm member may reciprocate within a guide, and the guide may comprise a U-shaped channel formed with a base wall and a pair of upwardly extending side walls. The platform may be supported by the upwardly extending side walls such that the reciprocating arm member can reciprocate below the platform.

To further facilitate ejection of tickets from the machine, there may be provided a device to align lower tickets of a column of tickets located in the ticket dispensing machine, and to facilitate exit of only one ticket at a time from the machine. This device can comprise a main body which can be mounted on the inside of the ticket machine and adjacent the ticket outlet. The main body may have a first depending arm which can extend behind the outfeed rollers and adapted to terminate above the ticket support platform by a spacing which allows only a single ticket to pass between the arm and the support platform. The device may include a second resilient arm which can be positioned in front of the first arm and can diverge from the main body, the second arm adapted to align front edges of lower tickets and which terminates above the ticket support platform by a distance at least that of the thickness of a ticket.

It is preferred that this device is integrally formed and that the resilient arm also provides a spacing of one ticket thickness.

The ticket dispensing machine may comprise at least one vertical chamber in which a column of tickets can be placed. The chamber may have a bottom which may comprise the platform, reciprocating arm member and the device having the rocker arm as described above.

The vertical chamber may be defined by vertical side panels and a vertical rear panel. The vertical side panels may be adjustable relative to each other to accommodate tickets of different widths, and the back panel may be adjustable closer and further away from the ticket outlet to accommodate tickets of different lengths. The platform may include slots in which the back panel can locate, the slots being such that the thus formed chamber accommodates tickets of different lengths.

The ticket outlet of the ticket machine may be associated with the outfeed rollers. The outfeed rollers may comprise a pair of elongate counter-rotating rollers. Each roller may comprise an elongate shaft having a plurality of axially spaced elastomeric wheels. The wheels on one shaft may be aligned with and contacting the wheels on the other shaft such that the wheels run along each other while the shafts are slightly spaced apart. The wheels may comprise rings which can be partially recessed into annular recesses on the shaft, and each recess on the shaft may have a flat base wall and flat side walls.

BRIEF DESCRIPTION OF THE DRAWINGS

An embodiment of the invention will be described with reference to the following drawings in which.

BEST MODE

The ticket dispensing machine is typically the size of a domestic refrigerator and comprises an outer square cabinet body (not shown) having a front door which can be opened to access the internal componentry of the machine and to also add new tickets, and which door can be securely locked.

Figure 1:
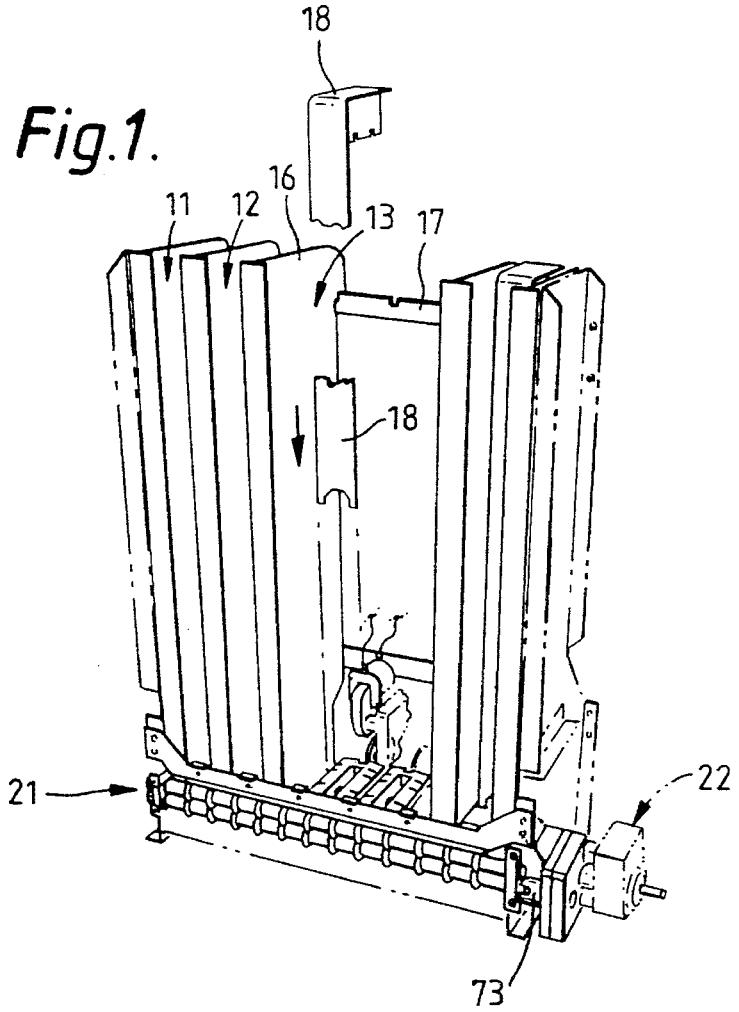
FIG. 1 shows the internal workings of a ticketing dispensing machine.
Figure 2:
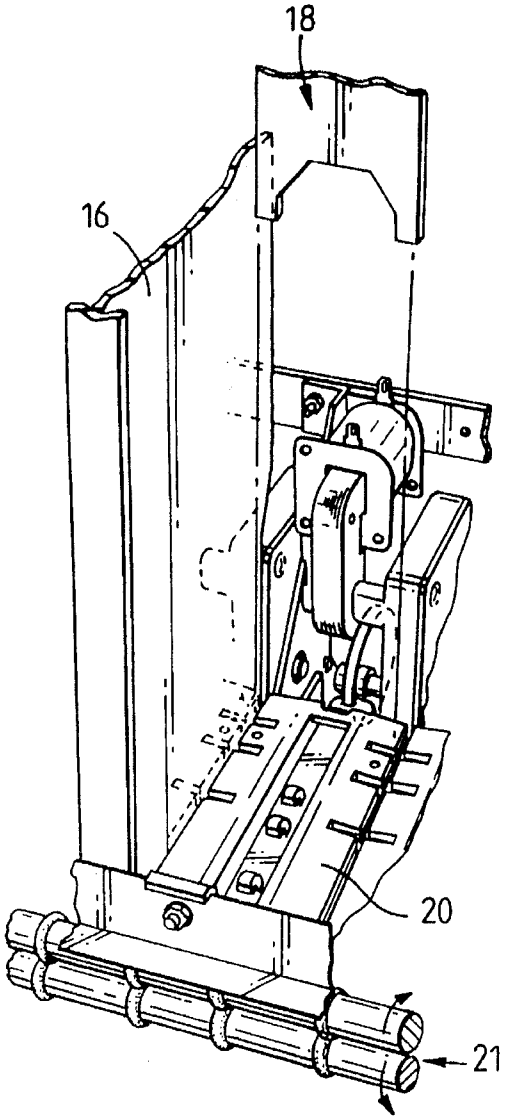
FIG. 2 is a partially cut away view of one of the chambers in the machine for dispensing tickets.

FIG. 1 shows some of the internal componentry of the machine. The internal componentry comprises a plurality of vertically extending chambers in which columns of tickets can be placed. It can be seen from FIG. 1 the machine can eject a number of tickets with each chamber housing tickets of one sort. Side walls of each chamber are defined by vertically extending metal panels (see, for instance, 16). The panels have notched upper areas to allow them to be fixed to a horizontal support bar 17. Horizontal support bar 17 also has notches to allow the panels to be easily adjusted and fixed into place without requiring precise measurements to be made. The notches are stamped into horizontal support bar 17 at intervals corresponding to the width of most known types of cards or tickets. The back wall of each formed chamber is also defined by a vertically extending metal panel and a portion of one panel 18 is illustrated in FIGS. 1 and 2. Panel 18 has an upper portion which is notched to again allow it to be positioned and fastened to horizontal support bar 17. The lower end of panel 18 is formed with a pair of feet which can slot into slots on a bottom platform 20 at various positions along platform 20 to accommodate tickets of different lengths. FIG. 1 also shows outfeed rollers 21 to assist in ejecting a ticket and drive means 22.

Figure 3:
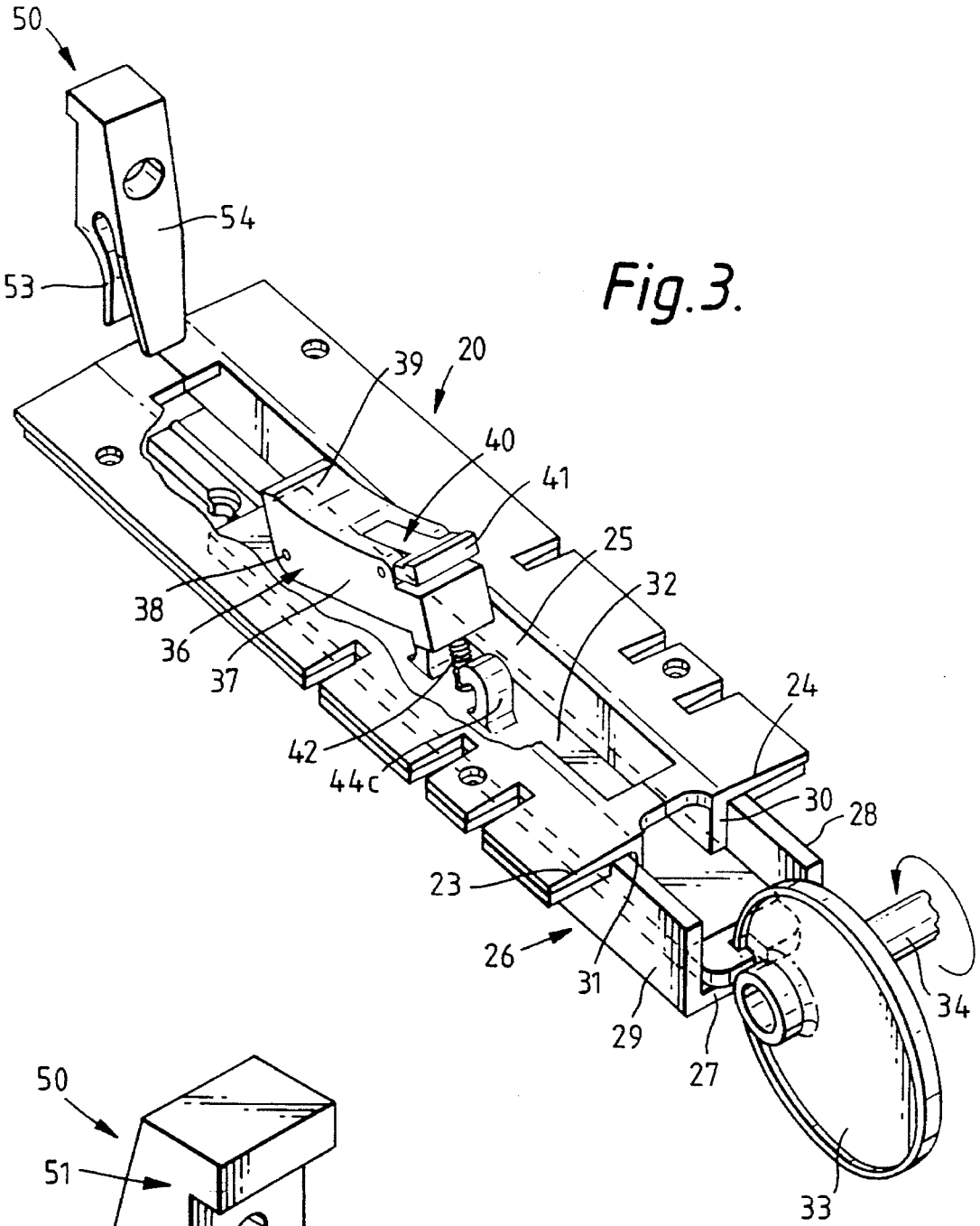
FIG. 3 is a perspective view of an apparatus which can support a column of tickets and eject the lowermost ticket from the column.

FIG. 3 illustrates a perspective view of platform 20 and associated componentry with it. Platform 20 is elongate and rectangular when viewed in plan and is substantially flat along its longitudinal axis. Across its width, it can be seen that platform 20 has downwardly sloping opposing wings 23, 24 such that the upper surface of platform 20 is curved downwardly. The function of the curve is to assist in correctly and reliably ejecting tickets or cards which are themselves curved and not perfectly flat. Platform 20 has a longitudinal slot 25 extending along the middle of the platform and almost from the front edge to the rear edge. Platform 20 is positioned on top of a guide 26, the guide comprising a flat base wall 27 and a pair of opposed side walls 28, 29. Platform 20 has a pair of inwardly spaced and depending side walls 30, 31 which pass into guide 26 such that the platform is supported by guide 26. The platform is fixed to guide 26 such that it does not move relative to the guide. Within guide 26 is located a reciprocating arm member 32. Arm member 32 is an elongate rectangular flat plate and reciprocates between a forward ticket ejecting position and a retracted position, the retracted position shown in FIG. 3. Arm member 32 has a notch adjacent its trailing end which extends about a cam wheel 33, the cam wheel being attached to a shaft 34. Shaft 34 is eccentrically mounted on cam wheel 33, rotation of the shaft results in arm member 32 exhibiting reciprocal movement within guide 26.

Located on top of arm member 32 is a device 36 for pushing a lowermost ticket in a column of tickets located within the respective chamber. Device 36 comprises a main body 37 which is pivotally connected to arm member 32 through a shaft 38 which extends across main body 37. An upper surface 39 of main body 37 is curved in a concave manner again to facilitate ejecting of tickets. On a rear portion of main body 37 is located a rocker arm 40 which can rock between a downward retracted position and an upward extended position. Rocker arm 40 has a portion 41 which is adapted to engage with the rear edge of a ticket to be dispensed. This portion is in the form of a shoulder or raised lip which is raised exactly by the thickness of the lowermost ticket. Thus, raised lip 41 does not extend far enough to engage with the rear edge of the second ticket. The function of rocker arm 40 is to facilitate correct engagement with the rear edge of only the lowermost ticket, even if the ticket is curved or distorted and not exactly flat.

Device 36 is naturally biased to an extended raised position by a spring 42 which extends between the device 36 and arm member 32. The spring is also attached distal from shaft 38 and in the region of rocker arm 40.

The device 36 is pivotally mounted to arm member 32 by a hook **44*a* extending above and integrally formed with the arm member 32. Hook 44*a* engages about shaft 38. It can be seen that device 36** can be easily removed from arm member

32.

Figure 4:
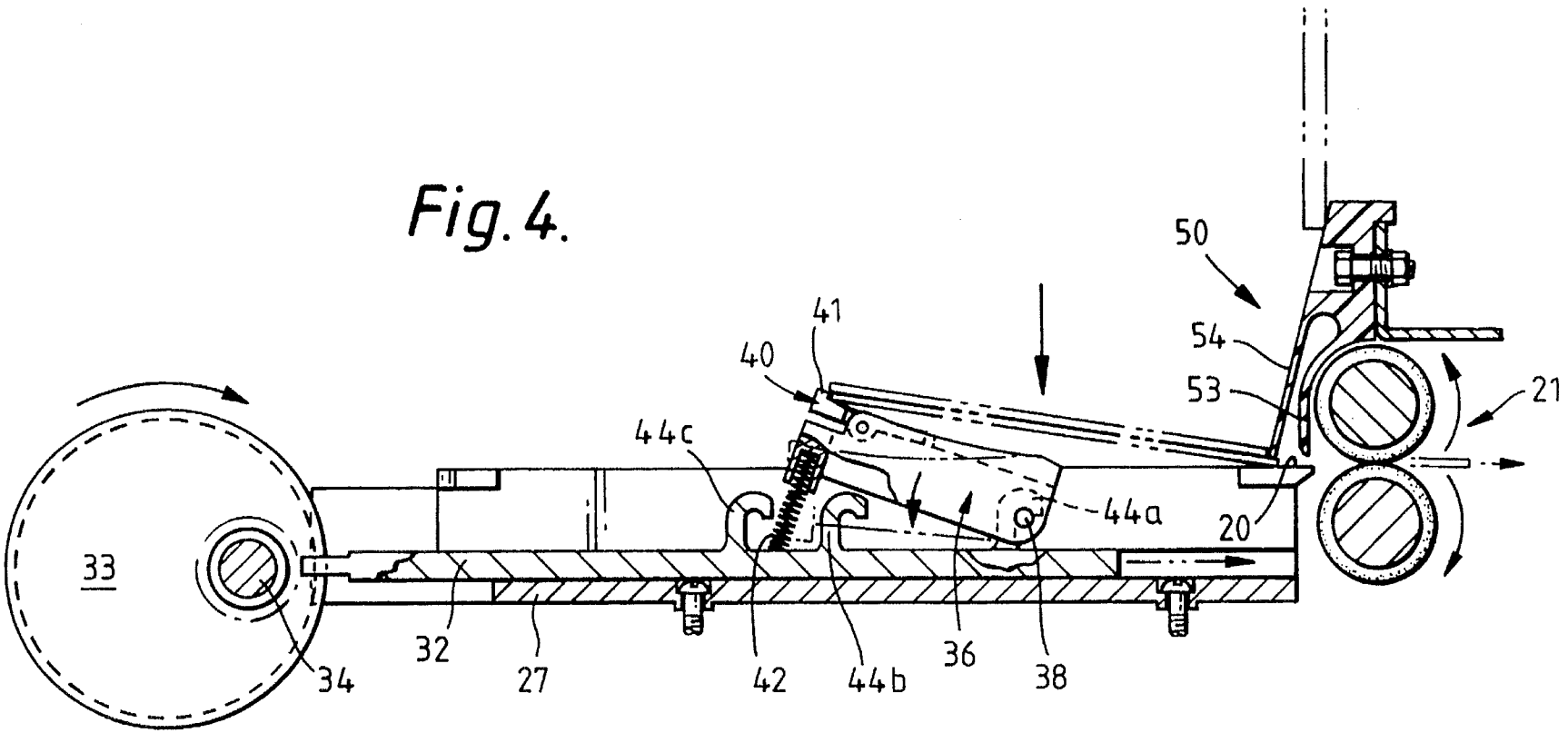
FIG. 4 is a side partially cut away view of the apparatus of FIG. 3.

Arm member 32 is provided with other hooks 44*b*, 44*c* which are in a spaced linear alignment with each other. Device 36 can be attached to any one of hooks 44*a*, 44*b* or 44*c* which in turn allows the ticket dispensing machine to eject tickets of different lengths. For instance, FIG. 4 shows the device attached to hook 44*a* and therefore making it suitable for tickets of the smaller length. If device 36 is attached to hook 44*b* or 44*c*, progressively longer tickets can be used. It is important that the spacing between projection 41 and the ticket outlet is approximately that of the length of the ticket, and therefore hooks 44*a–c* are precisely positioned.

Figure 5:
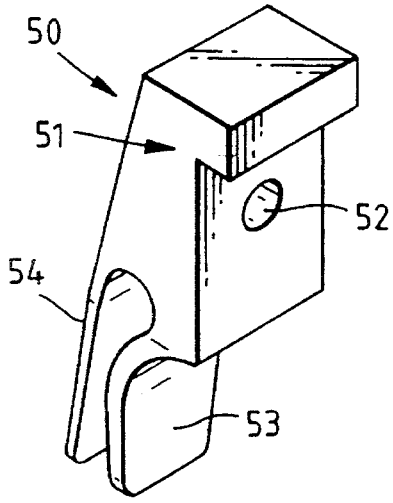
FIG. 5 is a rear perspective view of a device to align lower tickets of a column of tickets and facilitate exit of only one ticket.

FIG. 5 gives a perspective view of a second device to align lower tickets of a column of tickets located within a chamber and to facilitate exiting of only one ticket at a time. This device is also shown in FIGS. 3 and 4. The device has a main body 51 having an aperture therethrough 52, the aperture allowing the device to be bolted or otherwise attached adjacent the outfeed rollers 21 which is illustrated in FIG. 4. Main body 51 has a first depending arm 53 which is positioned immediately behind outfeed rollers 21 and terminates above platform 20 to provide a space which is exactly the thickness of one ticket. In front of first arm 53 is a second spring arm 54, this arm diverging from arm 53 and also terminating above platform 20 to define a space of one ticket thickness. The function of device 50 is to facilitate the clean alignment of the front edges of tickets as the column of tickets moves downwardly. That is, spring arm 54 will align the column of tickets by providing a biasing action to push the tickets rearwardly to rear wall 18, thereby aligning all the front edges of the tickets.

Figure 6:
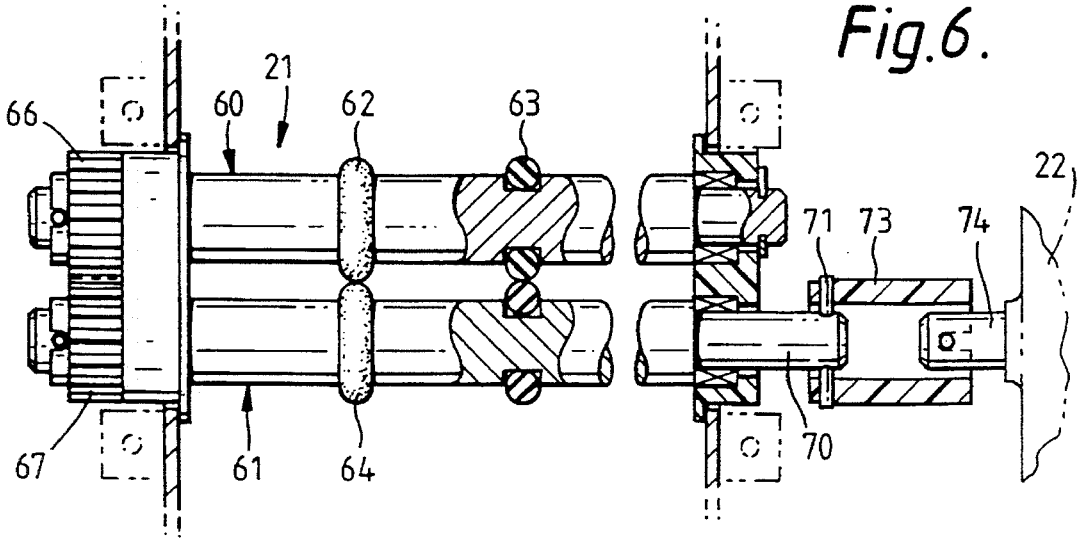
FIG. 6 is a front partially section view of the outfeed rollers associated with the ticket dispensing machine.
Figure 7:
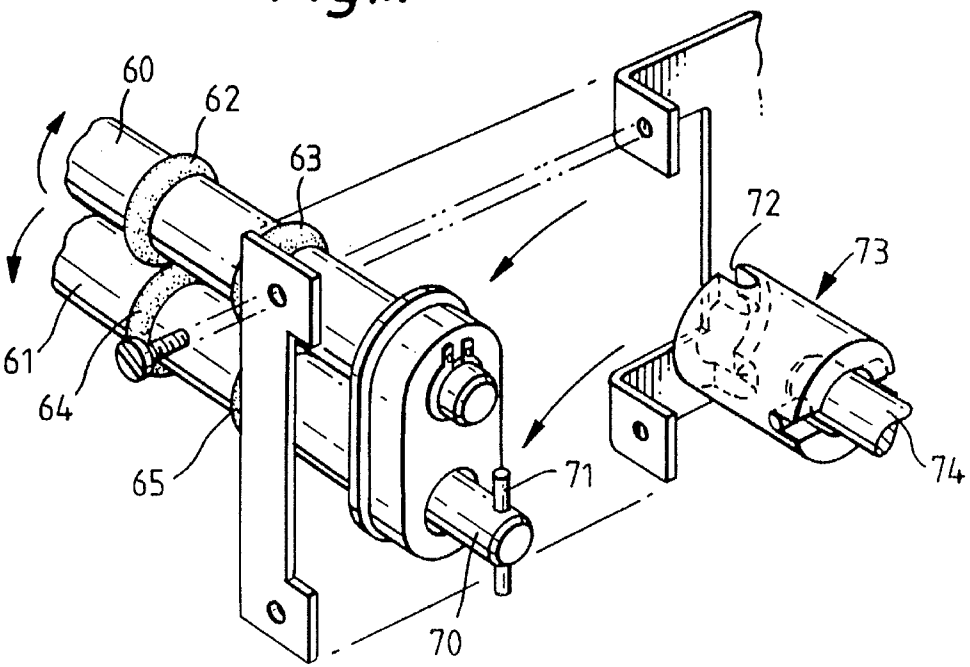
FIG. 7 is a close-up view of one side of the outfeed rollers.

FIGS. 6 and 7 show in greater detail the outfeed rollers 21. Outfeed rollers 21 comprise a pair of counter-rotating elongate shafts, being an upper shaft 60 and a lower shaft 61. The shafts are spaced apart and along each shaft is provided a number of axially spaced wheels 62–65. The wheels on the upper shaft are aligned with the wheels on the lower shaft such that as the shafts rotate, an upper wheel rides over and along a lower wheel. The wheels are formed from soft resilient elastomeric rings having a circular cross-section and which can be seen in FIG. 6. The shafts are also provided with annular recesses and these recesses have a flat base wall and flat side wall. Thus, the recesses are substantially rectangular, while the rings are circular. This arrangement facilitates the longevity of the outfeed rollers, as any pushing of the rollers together will deform the rings within the square or rectangular recesses. Thus, this particular arrangement provides a degrees of give in the rings. This is not found if the annular recesses in the shaft are of the same configuration as the rings.

The shafts are connected together by cogs 66, 67 in the usual manner and lower shaft 61 is driven by drive means 22 in the manner shown in FIGS. 6 and 7. That is, shaft 61 has an output shaft 70 of lower diameter formed with a T-piece 71, the T-piece slotting within a slot 72 on a connector 73 which also slots onto the drive shaft 74 of drive means 22.

In use, a coin is deposited in a coin slot in the ticket vending machine (not shown) and a selection is made as to what type of ticket is desired to be ejected. Drive means 22 is actuated and shaft 34 is caused to rotate which in turn results in arm member 32 being pushed forwards. The projection 41 on rocker arm 40 which is on device 36 is pushed forwards as device 36 is attached to arm 32. Arms 53 and 54 ensure that only the lowermost ticket is ejected and the lowermost ticket is then caught between two wheels of the opposed roller and is ejected to the customer. Shaft 34 continues to rotate sufficiently to retract arm member 32 which causes the machine to re-set itself and the next bottom ticket to be ready for ejection. Device 36 is continuously biased into engagement with the ticket column through spring 42 and the ticket column is continuously kept in alignment through spring arm 54.

Whatever curvature of the ticket presents itself, the spring-loaded selector presses upwardly seeking the trailing edge of the ticket to be dispensed. The action of the rocker arm additionally ensures that at the critical trailing edge of the ticket, the selector closely follows the surface of the ticket whatever its curvature and that clean engagement is made with one ticket only. By having device 36 pivoted upwardly, the ticket becomes inclined such that the front edge is lowered onto platform 20 even if it is slightly curved. This facilitates the front edge of the ticket to pass freely under the pre-set gap of device 50. The curved upper surface of device 36 also facilitates this action.

The downward slope of the surface of platform 20 is chosen to closely follow the curvature of tickets distorted across their axis convex down. This ensures that the centre of these tickets is not raised above the surface of the platform where they can foul the pre-set level of device 50.

It should be appreciated that other changes and modifications may be made to the embodiments described without departing from the spirit and scope of the invention.

I claim:

1. A device for pushing a lowermost ticket in a vertical column of tickets located in a ticket dispensing machine, the device having a main body adapted to be pivotally mounted adjacent a forward portion to a reciprocating arm member, the main body having an upper surface adapted to contact or be closely spaced from the under side of the lowermost ticket, a rocker arm pivotally attached to a rear position of a main body and having a portion which can engage with the rear edge of the lowermost ticket, the main body adapted to be biased against the lowermost ticket in use.

2. The device of claim 1 wherein the upper surface of the main body is curved and the rocker arm has an upper surface which curves to follow the curvature of the upper surface of the main body.

3. The device of claim 2 wherein the portion of the rocker arm is an upstanding shoulder dimensioned to contact the rear edge of only the lowermost ticket.

4. An apparatus for supporting a column of tickets and engaging a lowest ticket in the column, the apparatus comprising:

an arm member adapted for reciprocal movement between an extended ticket-engaging position and a retracted position;

a main body pivotally mounted adjacent a forward portion to said reciprocating arm member, said main body having an upper surface contacting or being closely spaced from the under side of the lowest ticket, a rocker arm pivotally attached to a rear portion of said main body and having a portion which can engage a sear edge of the lowest ticket , said main body biased against the lowest ticket when in use; and a platform for supporting the bottom of said column of tickets including the lowest ticket.

5. The apparatus of claim 4 wherein the platform is fixed and has a longitudinal slot passing therethrough, the arm member being positioned below the platform and the device extending at least partially through the slot and reciprocating with the arm member.

6. The apparatus of claim 5 wherein the arm member has a plurality of spaced apart engagement means to which the device can be pivotally attached to make it suitable to dispense tickets of different lengths.

7. The apparatus of claim 6 wherein the engagement means are hooks about which the device can pivotly attach.

8. The apparatus of claim 6 wherein the platform is elongate and has a top surface which is flat in length but is downwardly sloping in width.

9. The apparatus of claim 5 wherein the arm member reciprocates along a U-shaped base, the platform being attached to the base, a trailing edge of the arm member being attached to a cam wheel.

10. A device to align lower tickets of a column of tickets located in a ticket dispensing machine and to facilitate exit of only one ticket at a time from the machine, the device comprising a main body adapted to be mounted adjacent a ticket outlet, a first depending arm adapted to be positioned behind outfeed rollers and adapted to terminate above a ticket support platform to define a spacing which allows only a single ticket to pass through the spacing, and a second resilient arm positioned in back of the first arm and diverging from the main body, the second arm adapted to align front edges of lower tickets in said column and terminating above the ticket support platform by a distance at least that of the thickness of a ticket.

11. A ticket dispensing machine comprising:

at least one vertical chamber to accept a column of tickets, the chamber having a bottom comprising a platform for supporting a bottom of the column of tickets;

a reciprocating arm member; and a main body pivotally mounted adjacent a forward portion to said reciprocating arm member, said main body having an upper surface contacting or being closely spaced from the under side of a lowest ticket in said column of tickets, a rocker arm pivotally attached to a rear portion of said main body and having a portion which can engage a rear edge of said lowest ticket, said main body biased against said lowest ticket when in use.

12. The machine of claim 11 having a ticket outlet associated with a pair of counter-rotating outfeed rollers, each roller comprising an elongate shaft having a plurality of axially spaced elastomeric wheels, a wheel on one shaft being aligned with and contacting the wheel of the other shaft such that the wheels run along each other, characterised in that the wheels comprise rings and are partially recessed into annular recesses on each shaft, each recess having a flat base wall and flat side walls.

13. A ticket dispensing machine as recited in claim 11 further comprising a device to align lower tickets of said column of tickets located in said machine and to facilitate exit of only one ticket at a time from said machine, said device comprising:

a second main body mounted adjacent a ticket outlet; a first depending arm positioned behind outfeed rollers and terminating above said platform to define a spacing which allows only a single ticket to pass through the spacing; and a second resilient arm positioned in back of said first arm and diverging from said second main body, said second arm for aligning front edges of lower tickets in said column and terminating above said platform so that it is spaced therefrom a distance at least equal to the thickness of a ticket.

* * * * *